US006643487B1

(12) United States Patent
Shimmura

(10) Patent No.: US 6,643,487 B1
(45) Date of Patent: Nov. 4, 2003

(54) IMAGE FORMING APPARATUS USING INTERMEDIATE TRANSFER BODY

(75) Inventor: Shoko Shimmura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/234,703

(22) Filed: Sep. 5, 2002

(51) Int. Cl.[7] ..... G03G 15/01
(52) U.S. Cl. ..... 399/302; 399/308
(58) Field of Search ..... 399/302, 308, 399/150, 149

(56) References Cited

U.S. PATENT DOCUMENTS

| | | | | | |
|---|---|---|---|---|---|
| 5,237,374 | A | * | 8/1993 | Ueno et al. | 399/149 |
| 5,753,396 | A | | 5/1998 | Nakamura et al. | |
| 5,797,070 | A | | 8/1998 | Waki et al. | |
| 6,016,417 | A | * | 1/2000 | Katsuno et al. | 399/308 |
| 6,078,775 | A | * | 6/2000 | Arai et al. | 399/308 |
| 2003/0002892 | A1 | * | 1/2003 | Saito et al. | 399/302 |

FOREIGN PATENT DOCUMENTS

| | | | | | |
|---|---|---|---|---|---|
| JP | 5-303233 | A | | 11/1993 | |
| JP | 2001235946 | A | * | 8/2001 | G03G/15/16 |

* cited by examiner

*Primary Examiner*—Sophia S. Chen
*Assistant Examiner*—Ryan Gleitz
(74) *Attorney, Agent, or Firm*—Foley & Lardner

(57) ABSTRACT

In an image forming apparatus employing an electrophotographic process in which a toner image formed on a photosensitive body is primarily transferred to an intermediate transfer body, and thereafter a secondary transfer is provided on a transfer medium, surface roughness RzD1 of the photosensitive body is set to 0.01 to 10 $\mu$m, and surface roughness RzD2 of the intermediate transfer body is set to 1 to 30 $\mu$m, moreover being RzD1<RzD2. Concavo-convex slots approximately in parallel in a progressing direction may be formed over at least all image preparing region of the surface of the intermediate transfer body. As a developing toner, preferably, a spherical toner is employed. According to the image forming apparatus as described, a quantity of waste toner can be reduced, and it is possible to prevent deterioration of image quality of scattering of toner, slip-out of images, a mixture of colors or the like.

10 Claims, 4 Drawing Sheets

IMAGE FORMING APPARATUS USING INTERMEDIATE TRANSFER BODY

BACKGROUND OF THE INVENTION

1. Field of the Invention

The present invention relates to an image forming apparatus employing an electrophotographic process such as a laser printer, an electrophotographic copying machine and so on.

2. Related Art Statement

A conventional image forming apparatus employing an electrophotographic process is designed so that a transferred remaining toner remained on a photosensitive body is recovered by a cleaning device, which is discharged as waste toner outside the apparatus. Since in the waste toner, often, paper powder is mixed, and characteristics outside an average particle diameter or an average quantity of charge are present, toners are abandoned without being recycled. This brings forth a rise in cleaning cost, a maintenance for replacing a waste toner box is necessary, and an environment is adversely affected.

In view of the foregoing, there has been proposed heretofore by TOSHIBA Ltd. a so-called cleanerless process in which a cleaning mechanism is not particularly provided, and where transferred remaining toner occurs on a photosensitive body, toner which is present in a non-image portion is recovered on the side of a developer carrier in a developing region during the next image preparing step for re-use for development. However, the transferred remaining toner often has a polarity reversed to the desired charge polarity under the influence of a transfer electric field or as its original properties, thus posing various problems such that the toner is not well recovered in the developing region but remained on the photosensitive body for a long period of time, resulting in filming afterward or, charging and exposing of the photosensitive body are impaired, resulting in a cause for inferior image as a memory of the previous image at the time of next image preparing step. In order to solve these problems, there are employed measures such that a memory stirring brush is provided, and a charger for arranging a desired charge polarity of a toner. However, at present, the construction becomes complicated, and the adverse influence of the transferred remaining toner cannot be removed completely, bringing forth a deterioration of image quality.

In the first place, if transfer efficiency of toner is high, a quantity of waste toner can be reduced, and even a cause for deterioration of image quality which poses a problem in a cleanerless process can be removed.

On the other hand, it is well known that by forming a toner into a spherical shape, transfer efficiency can be improved. A flowing property of toner is improved by forming a toner into a spherical shape, and a contact state between the toner and the photosensitive body comes close to a point contact, because of which adhesive force of toner with respect to the photosensitive body is reduced. However, adhesive force between a toner and a photosensitive body is reduced, and at the same time, adhesive force with an intermediate transfer body is also reduced. Therefore, a toner once transferred to the intermediate transfer body is moved at random from a position of a latent image in the vicinity of a boundary of a region to which a transfer electric field is applied and the toner becomes dust, and in a process for putting toner images of four colors one upon another on the intermediate transfer body, the toner which is already present on the intermediate transfer body is reversibly transferred to the photosensitive body at the time of thereafter transfer of toner to increase a quantity of waste toner, and further in a cleanerless process, there is a problem in that a toner is recovered in a developing device without modification to induce a mixture of colors. In a cleanerless process using a spherical toner, a procedure for improving a release property of the photosensitive body is employed in order to solve such as problem as described, but a problem such as scattering of toner cannot be basically solved unless adhesive force between the toner and the intermediate transfer body. is strengthened.

SUMMARY OF THE INVENTION

The present invention has been accomplished in view of problems as noted above with respect to prior art in an image forming apparatus employing an electrophotographic process, and has its object to provide an image forming apparatus in which a quantity of waste toner is reduced by improving transfer efficiency of toner, and it is also possible to prevent filming, a memory of images, scattering of toner, deterioration in image quality such as a mixture of colors.

For achieving the aforementioned object, the present invention provides an image forming apparatus employing an electrophotographic process in which a toner image formed on a photosensitive body is primarily transferred to an intermediate transfer body, and thereafter a secondary transfer is provided on a transfer medium, wherein surface roughness RzD1 of the photosensitive body is set to 0.01 to 10 $\mu$m, and surface roughness RzD2 of the intermediate transfer body is set to 1 to 30 $\mu$m, moreover being RzD1<RzD2.

DETAILED DESCRIPTION OF THE INVENTION

The form for carrying out the image forming apparatus according to the present invention will be explained in detail hereinafter with reference to the accompanying drawings.

EXAMPLE 1

Figure 1:
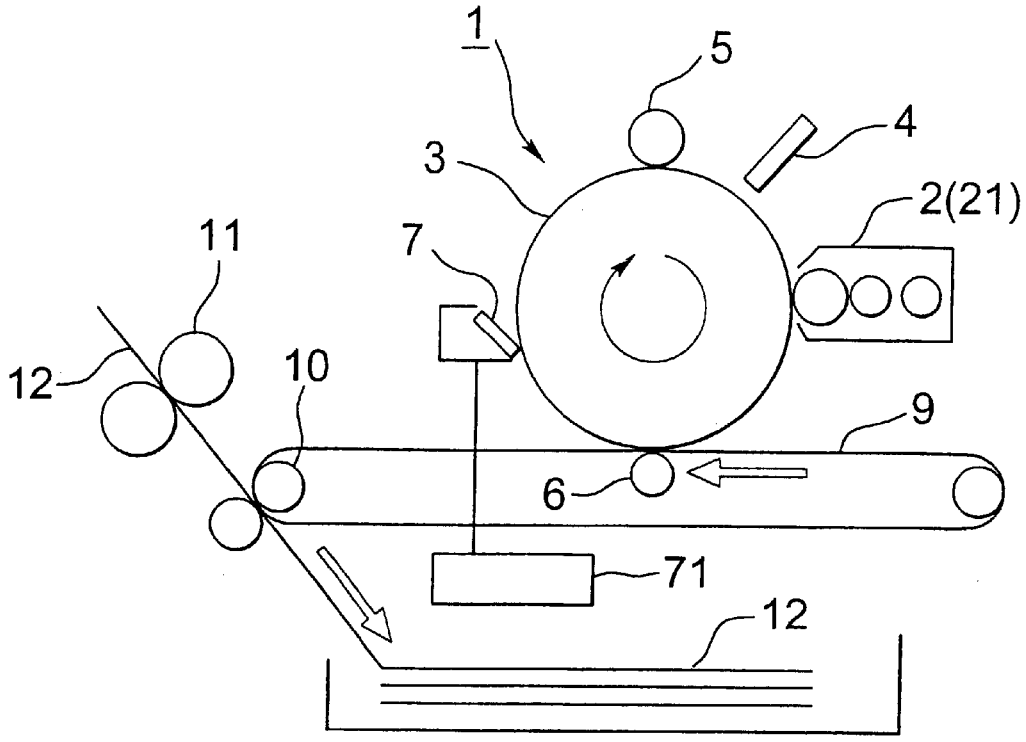
FIG. 1 is a sectional view of an image forming apparatus in which a photosensitive body having a single color developing device and a cleaner mounted is installed, and a toner image is transferred to an intermediate transfer body.

FIG. 1 shows an image forming apparatus 1 in which a charger 5 for charging a photosensitive body 3, an exposing device 4 for forming an electrostatic latent image on the photosensitive body 3, a developing device 2 (a single color developing device 21) for visualizing an electrostatic latent image, a primary transfer roller 6 and a cleaner 7 are disposed around the photosensitive body 3, and a single color toner image is transferred from the photosensitive body 3 to an intermediate transfer body 9.

The image forming apparatus 1 of the present invention is characterized in that the surface roughness of the intermediate transfer body 9 is set to be greater than that of the photosensitive body 3. The surface roughness ( 10 points average roughness RzD; a Germany Standard DIN4769) RzD1 of the photosensitive body 3 is 0.01~10 $\mu$m, preferably, 0.01~1 $\mu$m, and the surface roughness RzD2 of the intermediate transfer body 9 is 1~30 $\mu$m, preferably, 2~10 $\mu$m, moreover, being RzD1<RzD2.

The surface of the photosensitive body 3 is charged to −400~−1,000 V by the charger 5, but here, after being charged to −700 V, the surface of the photosensitive body 3 is exposed in accordance with image data by the exposing device 4 such as a semiconductor laser to form an electrostatic latent image. 2-component developer comprising at least magnetic particles and colored resin particles charged to a negative polarity is inserted into a single color developing device 21, a developing bias voltage of −200~−700 V, here −400 V is applied to a developer carrier, and toner is adhered onto the photosensitive body 3 in accordance with the electrostatic latent image and developed.

When reaching a primary transfer region, a transfer bias voltage of 500~2,000 V, here 1,000 V is applied to the primary transfer roller 6, an electric field directed from the photosensitive body 3 toward intermediate transfer body 9 is generated, and the toner on the photosensitive body 3 is transferred to the intermediate transfer body 9.

In this region, it is necessary that toner has a characteristic that is easily moved away from the photosensitive body 3, but is hard to be moved away from the intermediate transfer body 9. Adhesive force of toner to the photosensitive body 3 includes van Der Waals force and electrostatic adhesive force generated by a potential distribution of the surface of the photosensitive body 3 and an electric charge owned by the toner itself. Force for transferring toner from the photosensitive body 3 to the intermediate transfer body 9 is force of an electric field enough to exceed adhesive force of toner to the photosensitive body 3, and in order to generate it, a bias voltage reversed in polarity to a surface potential of the photosensitive body 3 is applied to the primary transfer roller 6. Adhesive force of toner with respect to the intermediate transfer body 9 merely comprises van Der Waals force and force pressed toward the intermediate transfer body 9 by a transfer electric field, but the force caused by the transfer electric field becomes naturally weakened if a distance between electrodes is parted, and after all, the adhesive force of a toner with respect to the intermediate transfer body 9 includes the van Der Waals force and contact charged charge generated on the surface of the intermediate transfer body 9 by contact of toner having a charge or electrostatic adhesive force produced by a charge caused by induction polarization.

The charge generated on the surface of the intermediate transfer body 9 can be controlled by suitably setting magnitude of surface resistance, but when the surface resistance is excessively great, the secondary transfer becomes difficult, and the intermediate transfer body 9 becomes charged by application of a transfer bias voltage to require a discharge device, which is not preferred. Therefore, as a surface resistance value of the intermediate transfer body 9, $10^7$~$10^{12}$ Ωcm is preferable, and here, it is set to $10^9$ Ωcm. As materials for the intermediate transfer body 9, rubber such as ethylene propylene copolymer elastomer (EPDM), chloroprene rubber (CR), synthetic resins such as polyimide (PI), polycarbonate (PC), polyvinylidene fluoride (PVDF), ethylene tetrophloroethylene copolymer (ETFE) and the like are suitable, but particularly not limited thereto.

In order that the van Der Waals force between the intermediate transfer body 9 and the toner is made greater to make the adhesive force high, and that even if the force of an electric field becomes weakened, the toner is not scattered around an image portion, the surface of the intermediate transfer body 9 is formed into a rough surface by processing such as sand blasting to increase a surface area per unit surface. Thereby, a contact point between the toner and the intermediate transfer body 9 increases, and the distance between the surfaces becomes small, whereby the adhesive force of the toner with respect to the intermediate transfer body 9 increases so that the toner will not be scattered, thus enabling realizing high image quality while maintaining high transfer rate.

A toner image subjected to the primary transfer to the intermediate transfer body 9 is re-transferred to a transfer medium 12 such as paper by applying a secondary transfer bias voltage, 500~3,000 V, here 1,200 V to a secondary transfer roller 10 in a secondary transfer region, and heated and fixed by a fixing unit 11.

On the other hand, the transferred remaining toner slightly remained on the photosensitive body 3 after the toner image has been transferred to the intermediate transfer body 9 is recovered by the cleaner 7 comprised of a blade, a brush, a felt or the like, is collected in a waste toner box 71 for disposal.

EXAMPLE 2

Figure 2:
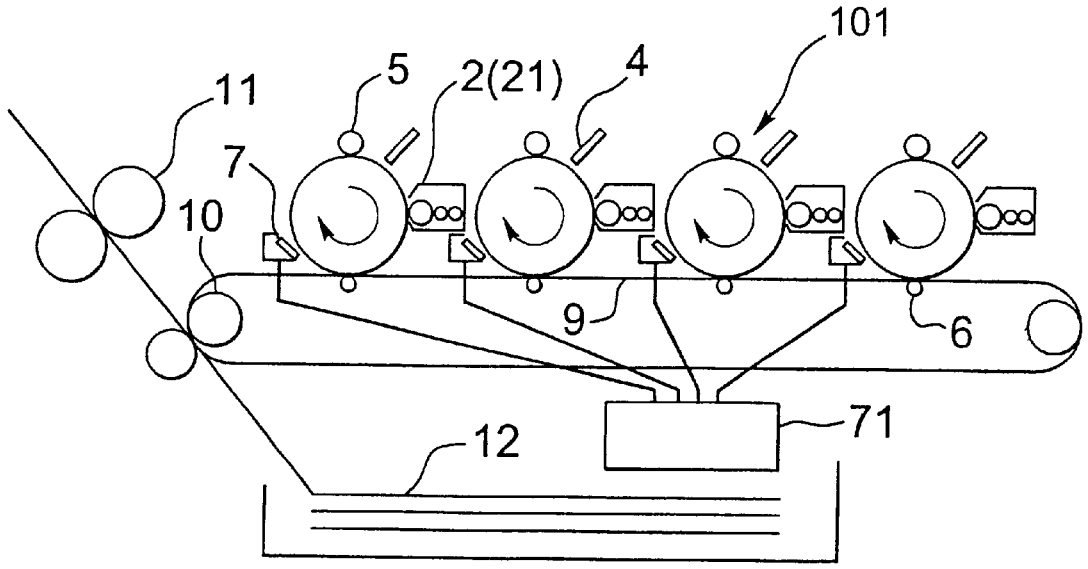
FIG. 2 is a sectional view of an image forming apparatus in which four sets of units comprising a photosensitive body having a single color developing device and a cleaner mounted are juxtaposed onto an intermediate transfer body, and four-color toner images are put one upon another and transferred to the intermediate transfer body.

FIG. 2 shows a full color image forming apparatus 101 wherein four sets of units in which a charger 5, an exposing device 4, a developing device 2 (a single color developing device 21), a primary transfer roller 6 and a cleaner 7 are disposed around a photosensitive body 3 are arranged in parallel on an intermediate transfer body 9, and toner images prepared by toners of four colors, Y (yellow), M (magenta), C (cyan), and K (black) are sequentially put one upon another on the intermediate transfer body 9 and transferred. It is noted that arranging order of four colors is not limited thereto.

Also in the image forming apparatus 101 of the present invention, surface roughness of the intermediate transfer body 9 is set to be greater than that of the photosensitive body 3, but here, the surface roughness RzD1 of the photosensitive body 3 is set to 0.5 $\mu$m, and the surface roughness RzD2 of the intermediate transfer body 9 is set to 3 $\mu$m.

First, a toner image of Y (yellow) is formed on the photosensitive body 3, and is transferred to the intermediate transfer body 9 by applying a transfer bias voltage of 900 V to the primary transfer roller 6 in a primary transfer region of Y (yellow). Then, a toner image of M (magenta) is formed on the photosensitive body 3, and is repeatedly transferred to the intermediate transfer body 9 on which the toner image of Y (yellow) has been already formed by applying a transfer bias voltage of 900 V to the primary transfer roller 6 in a primary transfer region of M (magenta). At this time, when the toner image of Y (yellow) on which toner of M (magenta) is not put comes in contact with the photosensitive body 3 of M (magenta), the toner image is adhered to the photosensitive body 3 of M (magenta) by contact charge between the surface of the photosensitive body 3 of M (magenta) and the toner of Y (yellow) or a transfer bias voltage reversed in polarity to a toner charge is received, whereby there occurs a possibility that toner of Y (yellow), which has carried reverse polarity by generating of charge putting, is reversibly transferred on the photosensitive body 3 side of M (magenta) in accordance with the transfer electric field, generating inferior images such as a slip-out of an image, a lowering of image concentration or a change in hue.

However, when the surface roughness RzD2 of the intermediate transfer body 9 is made to be rougher than the surface roughness RzD1 of the photosensitive body 3, the surface area per unit area increases so that the van Der Waals force between the intermediate transfer body 9 and the toner exceeds and becomes greater than the van Der Waals force between the photosensitive body 3 and the toner, and therefore, a toner of Y (yellow) transferred previously is not adhered to the photosensitive body 3 of M (magenta). The same is true for toners of Y (yellow) and M (magenta) with respect to the photosensitive body 3 of C (cyan), and toners of Y (yellow), M (magenta) and C (cyan) with respect to the photosensitive body 3 of K (black). It is noted that even if the primary transfer bias voltages of Y (yellow), M (magenta), C (cyan) and K (black) should be the same, they could be made to be different.

A secondary transfer bias voltage of 500~3,000 V, here 1,500 V is applied to the secondary transfer roller 10, toner images of four colors are transferred to the transfer medium 12 at once, after which they are heated and fixed by the fixing unit 11.

On the other hand, the transferred remaining toner slightly remained on each photosensitive body 3 after the toner image has been transferred to the intermediate transfer body 9 is recovered by each cleaner 7, and collected in the waste toner box 71 for disposal.

EXAMPLE 3

Figure 3:
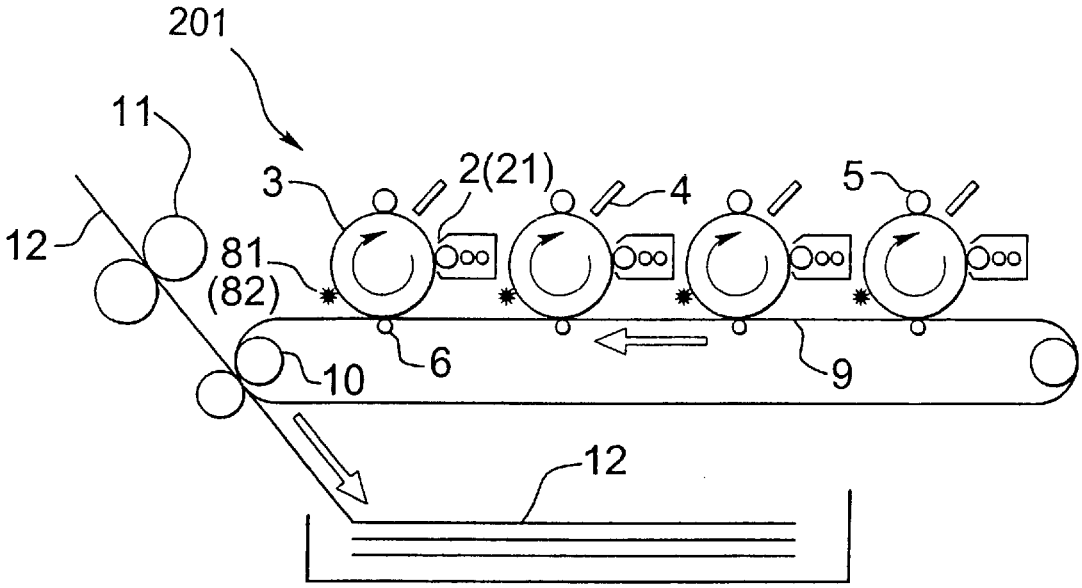
FIG. 3 is a sectional view of an image forming apparatus in which four sets of units comprising a photosensitive body having a single color developing device and a stirring brush mounted are juxtaposed onto an intermediate transfer body, and a cleaner-less process for putting four-color toner images one upon another and transferring them to the intermediate transfer body is employed.

FIG. 3 shows a full color image forming apparatus 201 wherein four sets of units in which a charger 5, an exposing device 4, a developing device 2 (a single color developing device 21), and a primary transfer roller 6 are disposed around a photosensitive body 3 are arranged in parallel on an intermediate transfer body 9, and toner images prepared by toners of four colors, Y (yellow), M (magenta), C (cyan), and K (black) are sequentially put one upon another on the intermediate transfer body 9 and transferred, but shows an image forming apparatus 201 employing a cleanerless process not provided with a cleaner for recovering the transferred remaining toner remained on the photosensitive body 3. It is noted that arranging order of four colors is not limited thereto.

Also in the image forming apparatus 201 of the present invention, surface roughness of the intermediate transfer body 9 is set to be greater than that of the photosensitive body 3, but here, the surface roughness RzD1 of the photosensitive body 3 is set to 0.1 $\mu$m, and the surface roughness RzD2 of the intermediate transfer body 9 is set to 5 $\mu$m.

First, a toner image of Y (yellow) is transferred to the intermediate transfer body 9, after which a transferred remaining toner slightly remained on the photosensitive. body 3 is recovered in a developing device 2 for re-use, thus generating no waste toner. Where all the transferred remaining toner cannot be recovered by the developing device 2, in which condition, a charge or an exposure is impaired, which likely adversely affects as a memory in a next image preparing step. Because of this, it is often that a memory removing device 81 such as a stirring brush for mechanically stirring the transferred remaining toner is disposed, or a charger 82 for arranging a polarity of the transferred remaining toner to the desired polarity to easily recover it by the developing device 2 is disposed.

Where adjustment of surface roughness is not carried out, when a toner image of M (magenta) is transferred to the intermediate transfer body 9 to which a toner image of Y (yellow) has been already transferred, a toner of Y (yellow) is adhered to the photosensitive body 3 of M (magenta) to induce image deteriorations such as a slip-out of an image or a lowering of concentration of an image. Further, since the cleanerless process is employed, a toner of Y (yellow) adhered to the photosensitive body 3 of M (magenta) is recovered in a single color developing device 21 of M (magenta), and a mixture of colors occurs. The same is true for the single color developing device 21 of C (cyan), and the single color developing device 21 of K (black).

However, according to the present invention, since the surface roughness RzD2 of the intermediate transfer body 9 is rougher than the surface roughness RzD1 of the photosensitive body 3, adhesive force between the toner and the intermediate transfer body 9 is so strong that a toner once adhered to the intermediate transfer body 9 is not re-adhered to another photosensitive body 3. Accordingly, even if the image forming apparatus is used for a long period of time, no mixture of colors occurs, an image of high quality can be maintained.

Surface Form of Intermediate Transfer Body

Figure 4:
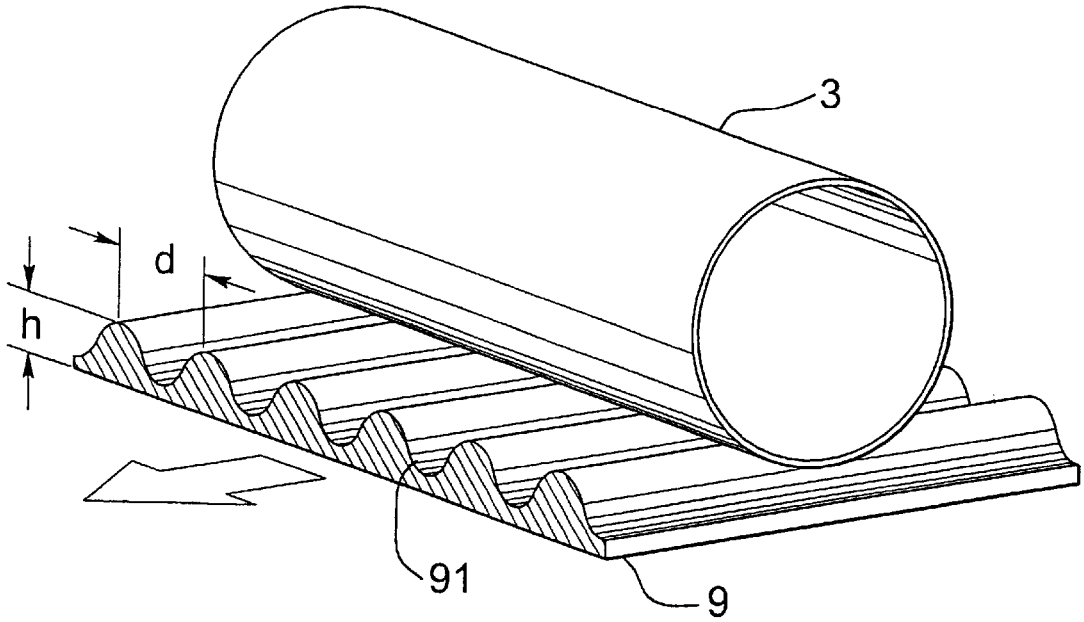
FIG. 4 is an explanatory view schematically showing a contact state between an intermediate transfer body formed with a concavo-convex slot and a photosensitive body.

FIG. 4 is an explanatory view schematically showing a contact state between an intermediate transfer body 9 formed with countless concavo-convex slots 91 approximately parallel with a progressing direction over at least the whole image preparing region and a photosensitive body 3.

As a special form for forming the surface of the intermediate transfer body 3 into a rough surface, the concavo-convex slots 91 may be formed on the surface of the intermediate transfer body 9. Preferably, the concavo-convex slots 91 are formed approximately parallel with a progressing direction of the intermediate transfer body 9, particularly within a range of being inclined by ±20° with respect to the progressing direction of the intermediate transfer body 9 over at least the whole image preparing region of the surface of the intermediate transfer body 9. A concavo-convex period of the concavo-convex slots 91 is set to be smaller than a write emitting period of the exposing device 5, and for example, where a write resolution is 600 dpi, a length d of one period of the concavo-convex slots 91 is set to not more than 40 $\mu$m, preferably, 800~5,000 line/inch. Further, a difference in level h between concave part and convex part is approximately 1~20 $\mu$m, and when the difference in level h is so large that a difference in forces of an electric field between concave part and convex part becomes excessively large, making it difficult to provide an even transfer, which is not preferable.

Figure 5:
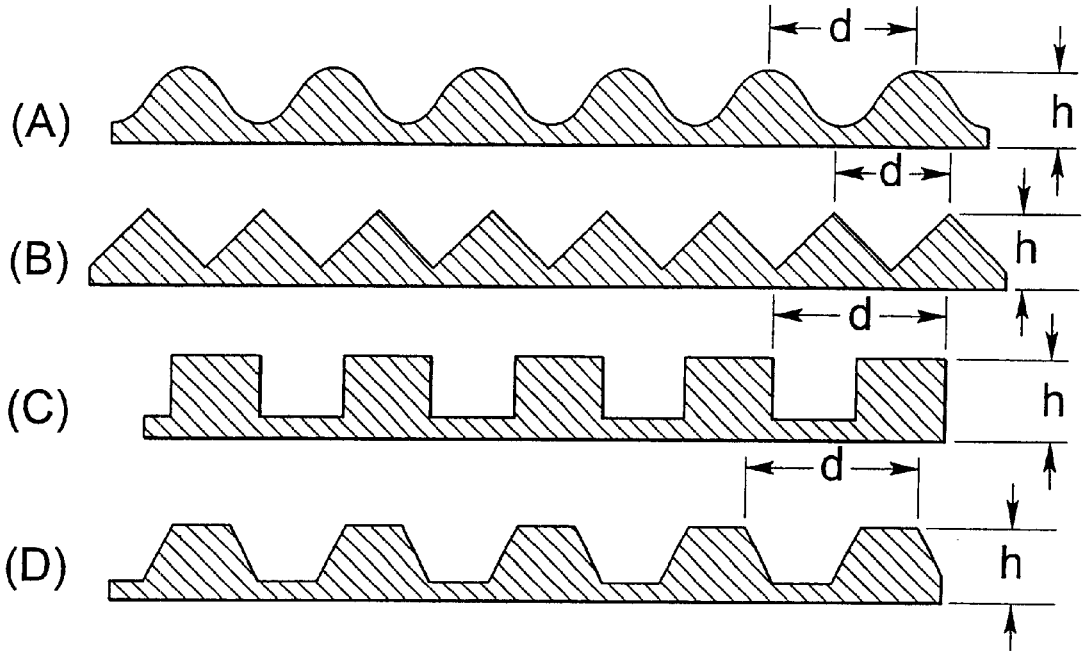
FIGS. 5(A), (B), (C), (D) are respectively enlarged sectional views showing typical four examples of the concavo-convex slots formed on the intermediate transfer body.

FIGS. 5(A), (B), (C) and (D) show typical four examples of the concavo-convex slots 91 formed on the surface of the intermediate transfer body 9. That is, the concavo-convex slots 91 of (A) whose sectional shape is a sine wave type, (B) which is a saw blade wave type, (C) which is a square wave type or (D) which is a trapezoidal wave type are formed on the surface of the intermediate transfer body 9.

Since the surface area per unit area of the intermediate transfer body 9 is increased by using the aforementioned intermediate transfer body 9, adhesive force with a toner increases, and scattering of toner in the periphery of an electrostatic latent image and reverse transfer of toner to the photosensitive body 3 and the like can be prevented, high image quality is obtained, and a toner can be utilized efficiently.

Figure 6:
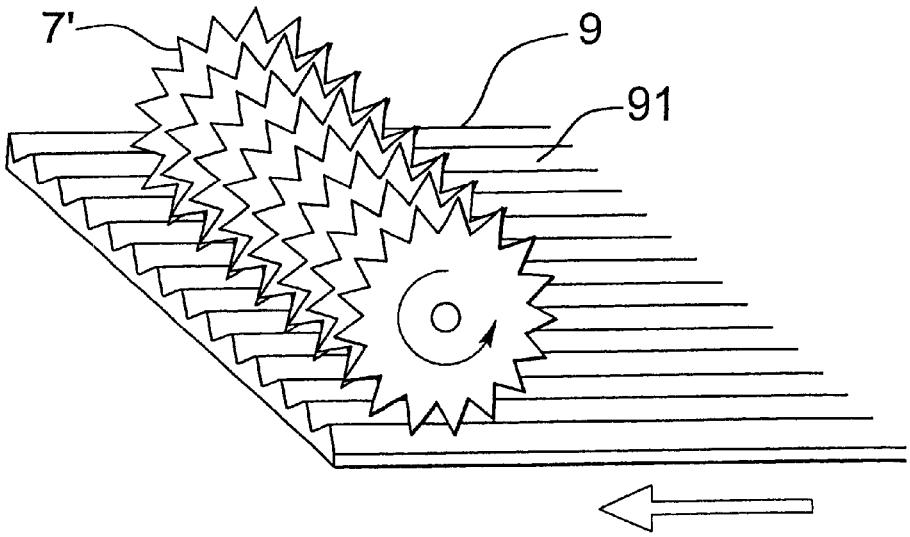
FIG. 6 is an explanatory view schematically showing a cleaning brush for cleaning the concavo-convex slots formed on the intermediate transfer body.

However, when the adhesive force of toner to the intermediate transfer body 9 is strengthened, there occurs a problem that in the secondary transfer, transferring to the transfer medium 12 such as paper becomes difficult, and therefore, it is necessary to remove the secondary transferred remaining toner. Here, as a means for removing the secondary transferred remaining toner, if a transfer body cleaner 7' such as a brush which rotates in a direction of an arrow is placed in contact therewith as shown in FIG. 6, toner remained on the intermediate transfer body 9 can be easily cleaned because the concavo-convex slots 91 are formed approximately in parallel in a progressing direction.

Adhesion State of Toner Particles

Figure 7:
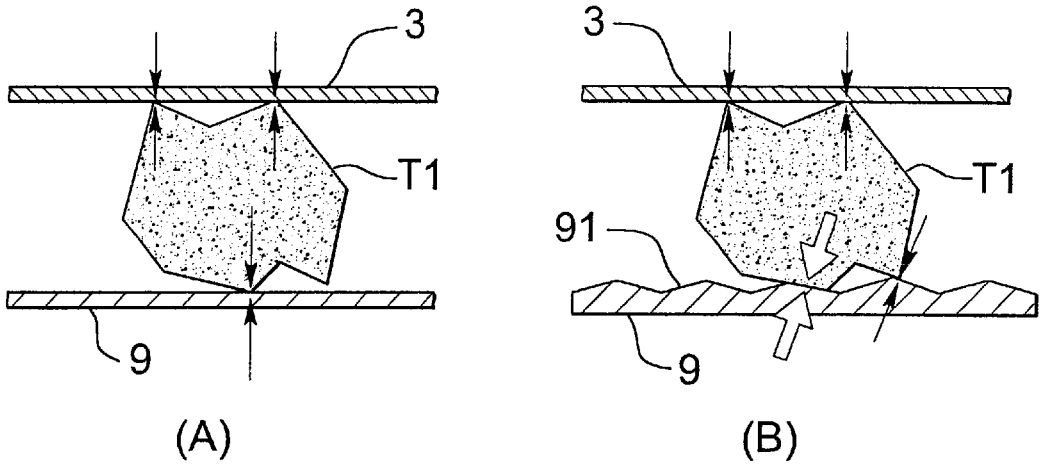
FIGS. 7(A), (B) are respectively explanatory views schematically showing an adhesion state of an indefinite toner with respect to the surface of a photosensitive body and the surface of an intermediate transfer body.
Figure 8:
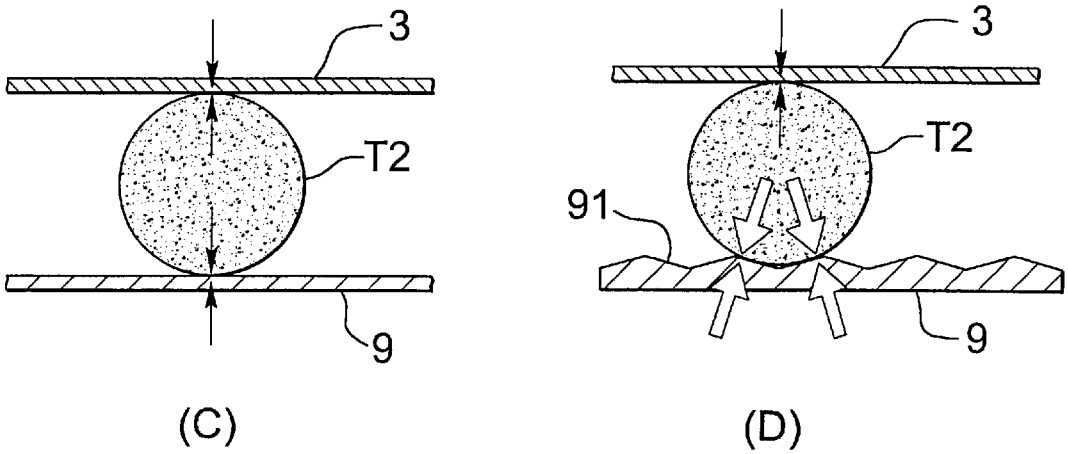
FIGS. 8(C), (D) are respectively explanatory views schematically showing an adhesion state of a spherical toner with respect to the surface of a photosensitive body and the surface of an intermediate transfer body.
Figure 1:
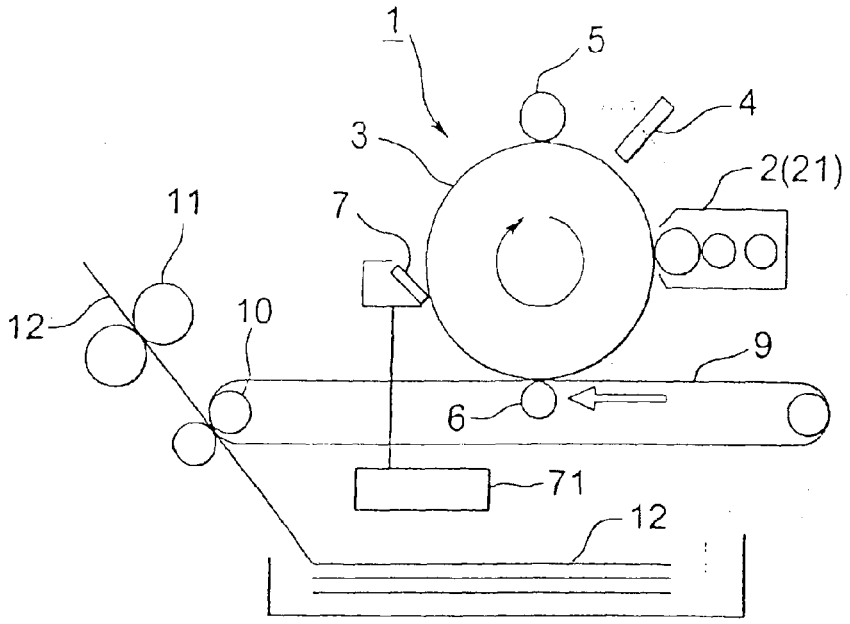
Figure 2:
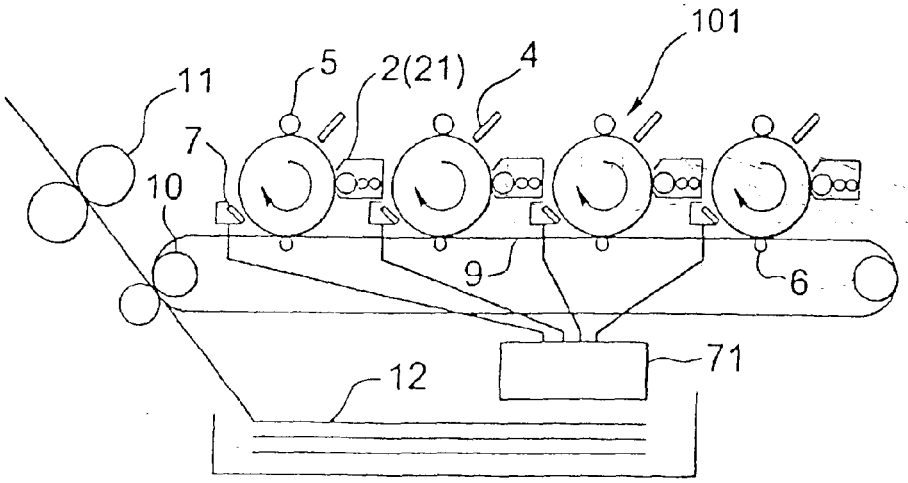
Figure 3:
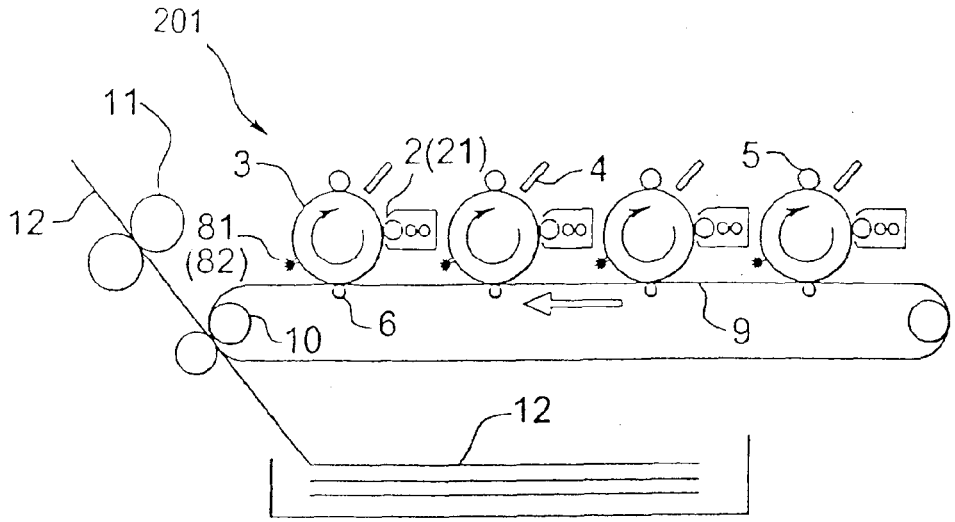
Figure 4:
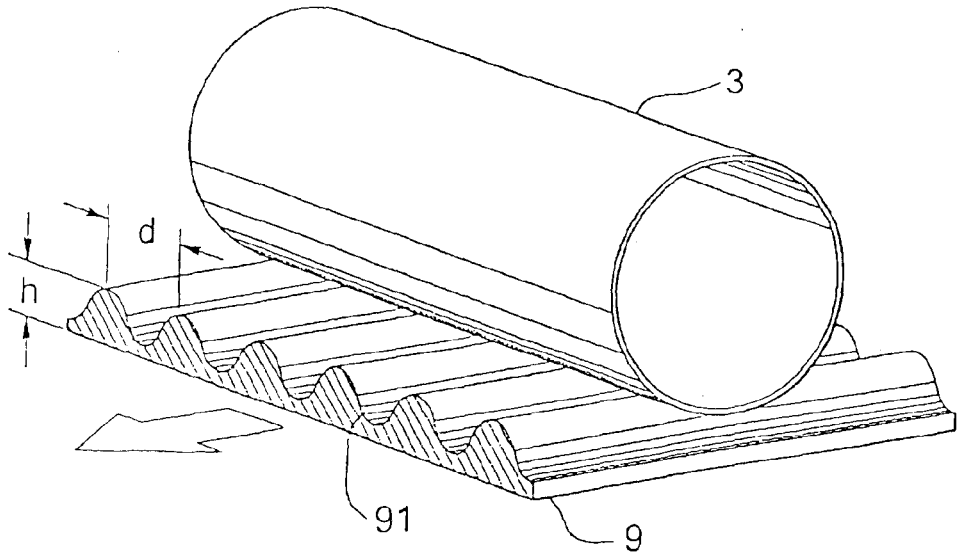

FIGS. 7(A), (B) are respectively sectional explanatory views schematically showing an adhesion state of an indefinite toner T1 with respect to the surface of the photosensitive body 3 and the surface of the intermediate transfer body 9, and FIGS. 8(C), (D) are respectively sectional explanatory views schematically showing an adhesion state of a spherical toner T2 with respect to the surface of the photosensitive body 3 and the surface of the intermediate transfer body 9.

Where the surface of the intermediate transfer body 9 is formed into a rough surface, that is, where concavo-convex is formed, a contact area between the toner and the intermediate transfer body 9 increases more than that between the toner and the photosensitive body 3, as shown by an arrow in the figures, irrespective of the indefinite toner T1 or the spherical toner T2, the adhesive force between the toner and the intermediate transfer body 9 increases more than that between the toner and the photosensitive body 3. In case of the indefinite toner T1, since the contact areas with the surfaces are different depending on the shape of toner particles, the strength of the adhesive force is variously changed to make it difficult to control. However, in case of the spherical toner T2, as shown by the bold arrow in FIG. 8(D), the contact area between the spherical toner T2 and the intermediate transfer body 9 increases and the adhesive force becomes large whereas the contact state between the spherical toner T2 and the smooth photosensitive body 3 is in a point contact and the adhesive force becomes extremely small, thus facilitating a transfer. And, in the spherical toner T2, since shapes of toner particles are put in order, the contact area is uniform, and a control of adhesive force can be carried out relatively easily. Accordingly, it is possible to select the optimum surface roughness of the intermediate transfer body 9 according to spherical degree, particle diameter, charged quantity of toner, surface qualities (surface energy, surface resistance or the like) of the photosensitive body 3 and the intermediate transfer body 9. With this, the remainder of transfer is reduced, and the reverse transfer also disappears, thus enabling improvement in consumption efficiency of toner, and further, deterioration of image caused by a mixture of colors of toner disappears, facilitating cleaning of the intermediate transfer body 9 also.

It is noted that the spherical toner T2 termed herein is one which fulfills with a relation that the ratio between a stokes diameter (Ds) and a diameter corresponding to an equal volume sphere (De) is $De/Ds \leqq 1.2$ by an authorized formula to provide spherical degree.

While in the above-described examples, a description has been made of a full color image forming apparatus of a 4-series dandem system in which four sets of units comprising a photosensitive body and a developing device are juxtaposed on a belt-like intermediate transfer body to sequentially carry out a transfer on the intermediate transfer body, the present invention can be also applied to a full color image forming apparatus of a rotary system in which a developing device unit having four developing devices incorporated therein is rotated to carry out development on the photosensitive body, and a transfer is repeatedly carried out on the intermediate transfer body.

What is claimed is:

1. An image forming apparatus using an intermediate transfer body employing an electrophotographic process in which an electrostatic latent image is formed by an exposing device on a photosensitive body charged by a charger, a toner image is formed on the photosensitive body by a developing device on the basis of said electrostatic latent image, the toner image formed on said photosensitive body is primarily transferred to the intermediate transfer body, and thereafter a secondary transfer is provided on a transfer medium, wherein surface roughness RzD1 of said photosensitive body is set to 0.01 to 10 $\mu$m, and surface roughness RzD2 of said intermediate transfer body is set to 1 to 30 $\mu$m, with RzD1<RzD2, wherein concavo-convex slots approximately in parallel in a progressing direction of the intermediate transfer body are formed over at least all of an image preparing region of the surface of said intermediate transfer body, and wherein a concavo-convex period of the concavo-convex slots is smaller than a write emitting period of the exposing device.

2. The image forming apparatus using an intermediate transfer body according to claim 1, wherein a spherical toner is employed as a developing toner.

3. The image forming apparatus using an intermediate transfer body according to claim 3, wherein a sectional shape of the concavo-concave slots is one of a sine wave type, a saw blade wave type, a square wave type, or a trapezoidal type.

4. The image forming apparatus using an intermediate transfer body, according to claim 1, wherein RzD2 is 2–10 $\mu$m.

5. The image forming apparatus using an intermediate transfer body, according to claim 1, wherein each concavo-convex slot has a concave part and a convex part, wherein a height difference between the concave part and convex part is 1–20 $\mu$m.

6. An image forming apparatus using an intermediate transfer body employing an electrophotographic process in which an electrostatic latent image is formed by an exposing device on a photosensitive body charged by a charger, a toner image is formed on the photosensitive body by a developing device on the basis of said electrostatic latent image, the toner image formed on said photosensitive body is primarily transferred to the intermediate transfer body, and thereafter a secondary transfer is provided on a transfer medium, and employing a cleanerless process, not provided with a cleaner, for cleaning a transferred remaining toner remained on said photosensitive body, wherein surface roughness RzD1 of said photosensitive body is set to 0.01 to 10 μm, and surface roughness RzD2 of said intermediate transfer body is set to 1 to 30 μm, with RzD1<RzD2, wherein concavo-convex slots approximately in parallel in a progressing direction of the intermediate transfer body are formed over at least all of an image preparing region of the surface of said intermediate transfer body, and wherein a concavo-convex period of the concavo-convex slots is smaller than a write emitting period of the exposing device.

7. The image forming apparatus using an intermediate transfer body according to claim 6, wherein a spherical toner is employed as a developing toner.

8. The image forming apparatus using an intermediate transfer body according to claim 6, wherein a sectional shape of the concavo-concave slots is one of a sine wave type, a saw blade wave type, a square wave type, or a trapezoidal type.

9. The image forming apparatus using an intermediate transfer body, according to claim 6, wherein RzD2 is 2–10 μm.

10. The image forming apparatus using an intermediate transfer body, according to claim 6, wherein each concavo-convex slot has a concave part and a convex part, wherein a height difference between the concave part and convex part is 1–20 μm.

* * * * *

UNITED STATES PATENT AND TRADEMARK OFFICE

CERTIFICATE OF CORRECTION

PATENT NO. : 6,643,487 B1
DATED : November 4, 2003
INVENTOR(S) : Shoko Shimmura

It is certified that error appears in the above-identified patent and that said Letters Patent is hereby corrected as shown below:

Drawings,
Please replace drawing sheets 1 and 2, consisting of figs 1-4 as shown on the attached pages.

Signed and Sealed this

Twentieth Day of July, 2004

JON W. DUDAS
*Acting Director of the United States Patent and Trademark Office*